United States Patent [19]

Nielsen

[11] Patent Number: 4,974,376

[45] Date of Patent: Dec. 4, 1990

[54] TEMPORARY SHELTER

[76] Inventor: David R. Nielsen, 8481 Utica Drive, Los Angeles, Calif. 90046-7717

[21] Appl. No.: 272,079

[22] Filed: Nov. 16, 1988

[51] Int. Cl.[5] ..... A47B 83/00

[52] U.S. Cl. ..... 52/28; 52/36; 52/38; 52/79.1; 52/173 R

[58] Field of Search ..... 52/79.12, 79.1, 169.1, 52/36, 200, 28, 38, 173 R; 5/2 R, 9 R; 119/17, 19

[56] References Cited

U.S. PATENT DOCUMENTS

| | | | |
|---|---|---|---|
| 3,087,458 | 4/1963 | Bennett | 119/19 |
| 3,731,657 | 5/1973 | Alessio | 119/19 |
| 3,808,607 | 5/1974 | Harder | 5/2 R |
| 3,924,571 | 12/1975 | Holman | 119/19 |
| 4,071,210 | 1/1978 | Mutke | 5/9 R |
| 4,073,101 | 2/1978 | Yoshida | 52/79.1 |
| 4,332,214 | 6/1982 | Cunningham | 119/19 |
| 4,395,788 | 8/1983 | Huh | 5/2 R |
| 4,421,097 | 12/1983 | Meckler | 52/200 |
| 4,505,078 | 3/1985 | Huh | 5/2 R |
| 4,594,817 | 6/1986 | McLaren | 52/36 |
| 4,674,476 | 2/1978 | Ordorika | 52/169.1 |
| 4,745,643 | 5/1988 | Clarke | 52/36 |
| 4,779,552 | 10/1988 | Harsia | 52/79.12 |

*Primary Examiner*—John E. Murtagh

*Attorney, Agent, or Firm*—Fulwider, Patton, Lee & Utecht

[57] ABSTRACT

A temporary shelter including a support structure extending upwardly from a base and hollow compartment members mounted upon the support structure, the hollow compartment further including an opening and a liquid drain. A window formed within the compartment walls transmits light from a light box mounted adjacent thereto and electrically connected to a power source.

4 Claims, 2 Drawing Sheets

TEMPORARY SHELTER

BACKGROUND OF THE INVENTION

1. Field of Invention:

The present invention relates generally to shelters and, more specifically, to a new and improved temporary shelter for multiple homeless inhabitants.

2. Description of the Prior Art:

As a result of various meteorlogical or geological disasters such as hurricanes, tornadoes or earthquakes, numerous homes or multiple-unit dwellings may be damaged or otherwise rendered uninhabitable. In addition, with the well-publicized increase in the number of "homeless" persons in the United States, there has been a corresponding increase in the need for an inexpensive way to shelter these persons. Construction of conventional low-cost housing in response to such demands has its limitations. Construction of multi-unit dwellings using conventional techniques usually requires a few months to a year for completion. While pre-fabrication processes have drastically reduced this construction time, current structures still require a relatively large foundation unit, such as a level concrete slab or fabricated floor. This inhibits the disassembly of the construction and usually requires relatively large parcels of real estate which may be unobtainable in the highly commercialized and valuable areas that the homeless often inhabit.

In addition, the construction of these multi-unit dwellings often requires a capital investment which communities are reluctant to make for non-revenue generating transient inhabitants. Indeed, this transiency further contributes to such reluctance on the part of the community, since there is no guarantee that the demand for such housing will be at the same levels when the construction is completed, and any construction of such housing may encourage an influx of more homeless people.

Alternatively, less permanent structures have their own limitations. Allowing the homeless to construct their own haphazard shelters can create an eye-sore and increase local community opposition. Generally, these structures are constructed of whatever material is available, most commonly canvas, cardboard or wood. These structures usually do not conform to community building codes enacted for safety and sanitary reasons. As a result, these structures are susceptible to the elements and tend to prevent their occupants from staying dry in inclement weather. These construction materials also tend to resist cleaning and are susceptible to vandalism. A damp, unclean environment is prone to breed vermin, unsanitary conditions and disease. As a result, many communities are reluctant to allow the location of such developments within their community.

Thus, those who have been involved in the development of shelter structures have long recognized the need for an improved structure which provides an inexpensive, easy to construct, warm and dry environment. The present invention fulfills all of these needs.

SUMMARY OF THE INVENTION

Briefly, and in general terms, the present invention provides a new and improved temporary shelter which is inexpensive, quickly and easily disassembled or assembled, and easily maintained clean, warm and dry.

By way of example, and not necessarily by way of limitation, the shelter structure of the present invention provides a plurality of individual compartments which are suspended by mounting them upon a support structure. Each individual compartment is constructed for easy cleaning and maintaining the inhabitants in a warm and dry environment.

In one preferred embodiment, the shelter structure of the present invention includes a base and structural support members extending generally vertically upwards therefrom. A plurality of horizontal cross-braces extend between said vertical members to support and mount a plurality of hollow individual compartment members thereon. Alternatively, the structural support members may be at an angle other than vertical, e.g., triangular in configuration, or may be centrally located with the cross-braces extending across the support members. Each of the compartment members defines a hollow interior and includes a sloping floor and drain. A longitudinal side opening allows access to the interior. A light box is mounted adjacent one longitudinal end of the compartment to illuminate its interior. The light box is a compartment containing a fluorescent or incandescent light that serves a number of purposes, including providing light and heat for the interior and light for a sign, advertising, or other identification if required. A power source is provided for the light box and for additional heating or electrical requirements.

From the above description it can be readily seen that the present invention provides a new and useful structure for the temporary housing of persons in an inexpensive, temporary, clean and dry environment. Other features and advantages of the present invention will become apparent form the following detailed description, taken in conjunction with the accompanying drawings, which illustrate by way of example, the principles of the invention.

DESCRIPTION OF THE PREFERRED EMBODIMENT

As shown in the exemplary drawings, an improved temporary structure constructed in accordance with the present invention is provided for housing a plurality of persons inexpensively in a clean and dry environment. In addition, the temporary shelter of the present invention, while avoiding the limitations present in more permanent structures, provides an easy to clean, dry and vandal-resistant structure.

Figure 1:
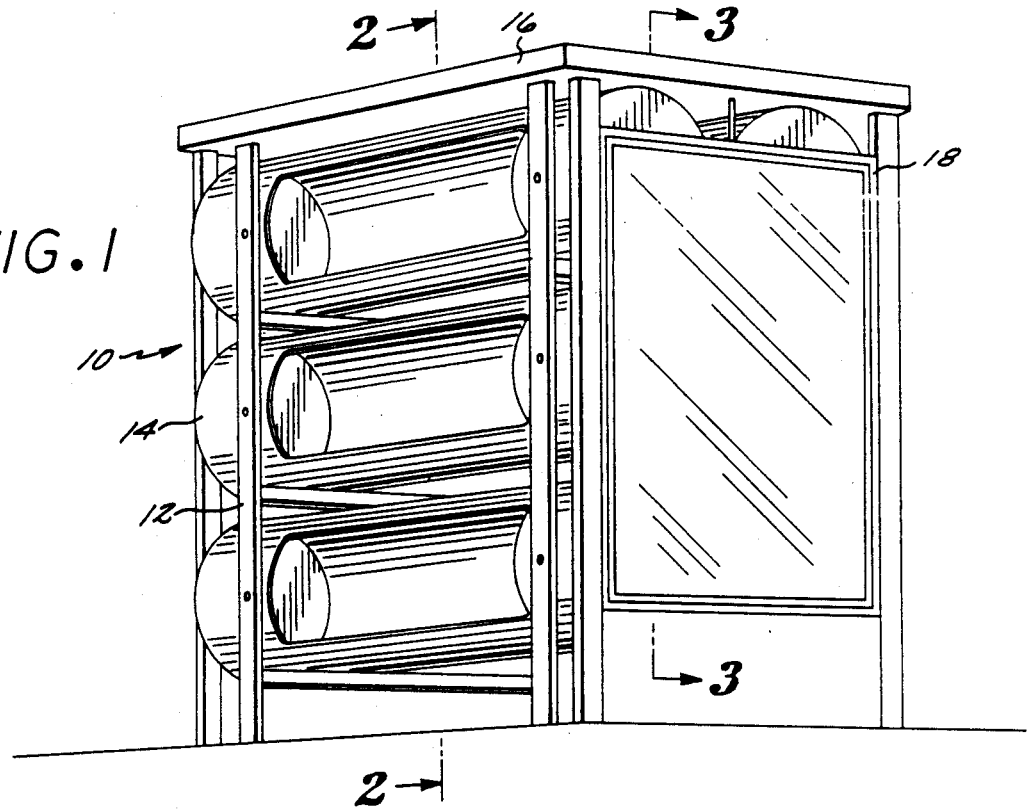
FIG. 1 is a perspective drawing of a temporary shelter structure incorporating the novel features of the present invention.

Referring to FIG. 1, the improved temporary shelter structure 10 of the present invention includes a structural support 12. Individual compartment members 14 are mounted upon the support 12 and formed to facilitate a dry but easily cleaned environment. A power source 16 is electrically connected to a light box 18 for illuminating and heating each individual compartment 14.

Figure 2:
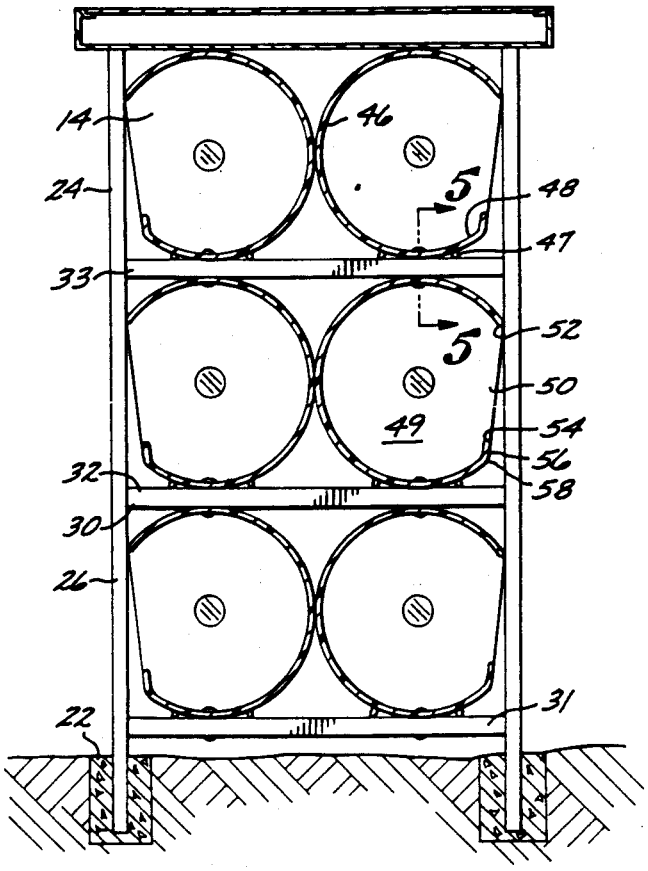
FIG. 2 is a front elevational sectional view of the present invention taken substantially along the line 2—2 of FIG. 1.

Referring to FIG. 2, the support 12 includes a base or foundation 22 placed on or below the ground level. This base or foundation may be in the form of a concrete or cement platform or merely cylindrical holes dug in the ground and filled with a cement or concrete material. Alternatively, the base may be a portable or moveable structure that includes means to mount the vertical support and provide a stable base for the housing unit. While a uniform platform extending beneath the entire shelter 10 may provide substantial stability, the base 22 need only preclude the settling or tipping over of the temporary shelter 10. For example, holes having a diameter of about two feet and a depth of about three feet filled with a foundation material are adequate. A base 22 so configured facilitates removal of the base 22 from the ground when the housing unit is no longer needed.

FIG. 2 also illustrates a plurality of generally vertical support members or legs 24 extending upward from the base 22. Each individual leg 24 extends above ground about eight to about nine feet while being spaced laterally apart from each other about four and one-half feet. While the support members 24 can be of any strong construction material, two by four inch (0.125 wall) structural steel members may be used. Extending transversely between the plurality of the vertical support members 24 is a plurality of generally horizontal cross-braces 30. For example, about four to about five foot lengths of two by four inch structural steel members may extend laterally between the generally vertical support members 24. A first plurality of cross-braces 31, 32 and 33 are mounted on a first pair of vertical supports 26 at a first, second and third vertical levels above the ground. The lowest cross-brace 31 can be spaced about two inches above the ground. Cross-braces 31, 32 and 33 are spaced apart from each other a sufficient distance to receive the compartment member 14 therebetween, for example about two-feet, six-inches apart. The plurality of cross-braces 30 are joined or mounted to the vertical support members 24 by conventional means, for example, by conventional welding or bolt means. Those skilled in the art of structural design will appreciate that many alternative structures may be configured to that described and illustrated. For example, the vertical support members may be replaced by members at an angle to the vertical or the members may be centrally located with the cross-braces 30 extending across them.

Still referring to FIG. 2, the plurality of individual compartment members 14 are mounted upon the cross-braces 30. While any desired number of compartment members 14 can be used, in one preferred embodiment, there are six compartment members 14 mounted longitudinally upon the cross-braces 30, a pair of compartment members 14 upon each plane defined in part by the corresponding individual cross-braces 31, 32 and 33. Each compartment member 14 can be formed of a double-walled structural fiberglass cylinder 36, having a first and second end walls 42 and 44 with a generally cylindrical side wall 46 extending therebetween to define a hollow interior 49. Structural ribbing 47, positioned longitudinally along the side wall 46 to engage or abut with the cross-braces 30, extends downward from a bottom portion 48 of the cylindrical wall 46. Each compartment member 14 is sized to comfortably receive a human being, and, for example, may have a radius of about one foot to about one foot-six inches and be about six feet, six inches in length.

Still referring to FIG. 2, a longitudinal entrance opening 50 is defined within a outward facing portion of the side wall 46 to allow access to the compartment member's hollow interior 49. The entrance 50 can be of any shape or size enabling access to the interior. For example, in the preferred embodiment, a generally rectangular opening about three-feet, six-inches long and about one-foot, six-inches in width is formed within the sidewall 46. An overhanging top edge 52 of the opening 50 is formed to project laterally outward beyond a bottom edge 54 about six inches downward from the apex of the compartment member 14. The bottom edge 54 of the opening 50 is formed inward about two inches from the most lateral projection of the overhanging top edge 52 by a generally vertical wall portion 56. The vertical wall portion 56 is formed by altering the curvature of the bottom portion of the compartment member 14, for example, by a bend 58 having a curvature of about a three inch radius. As a result, the bottom edge 54 is positioned inward relative the top edge 52 and extends vertically upward.

Figure 3:
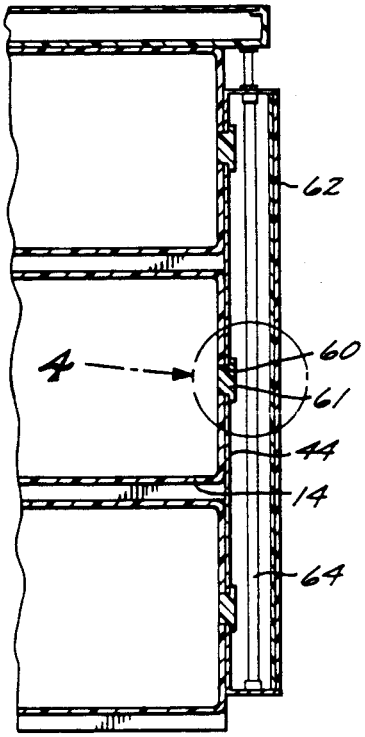
FIG. 3 is a fragmentary side elevational view of the present invention taken substantially along the lines 3—3 of FIG. 1.
Figure 4:
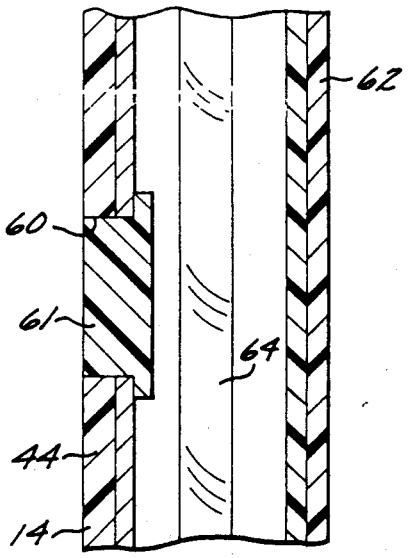
FIG. 4 is an enlarged, fragmentary sectional side elevational view of the present invention, taken substantially from the circle 4 of FIG. 3.

As best shown in FIGS. 3 and 4, formed in the second end wall 44 of the compartment member 14 is a window 60 for transmitting light into the interior 49 of the compartment 14 from the light box 18. In the preferred embodiment, a one-inch thick plexiglass plug 61 is fitted flush with the end wall 44. The window 60 is formed in the second end wall 44 along the central longitudinal axis of each compartment member 14. Adjacent to window 60 is the light box 18, having a fluorescent lamp 64, discussed more fully elsewhere in this application.

Figure 5:
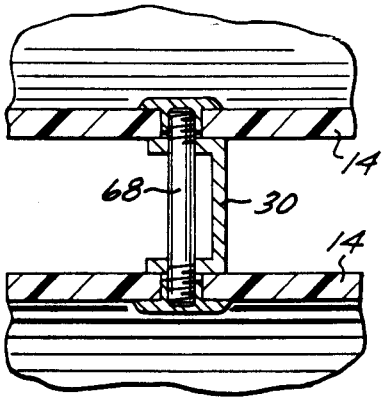
FIG. 5 is an enlarged, fragmentary side elevational sectional view of the present invention, taken substantially along the lines 5—5 of FIG. 2.

While conventional mounting means such as various bolt assemblies can be used, aluminium internal threaded, internal hex stadium seat-type bolt assemblies 68 as best shown in FIG. 5 may be used to mount the compartment members 14 to the cross-braces 30. This type of bolt assembly substantially inhibits disassembly by unauthorized persons, a strong possibility considering the intended use of the housing unit and its likely location.

Figure 6:
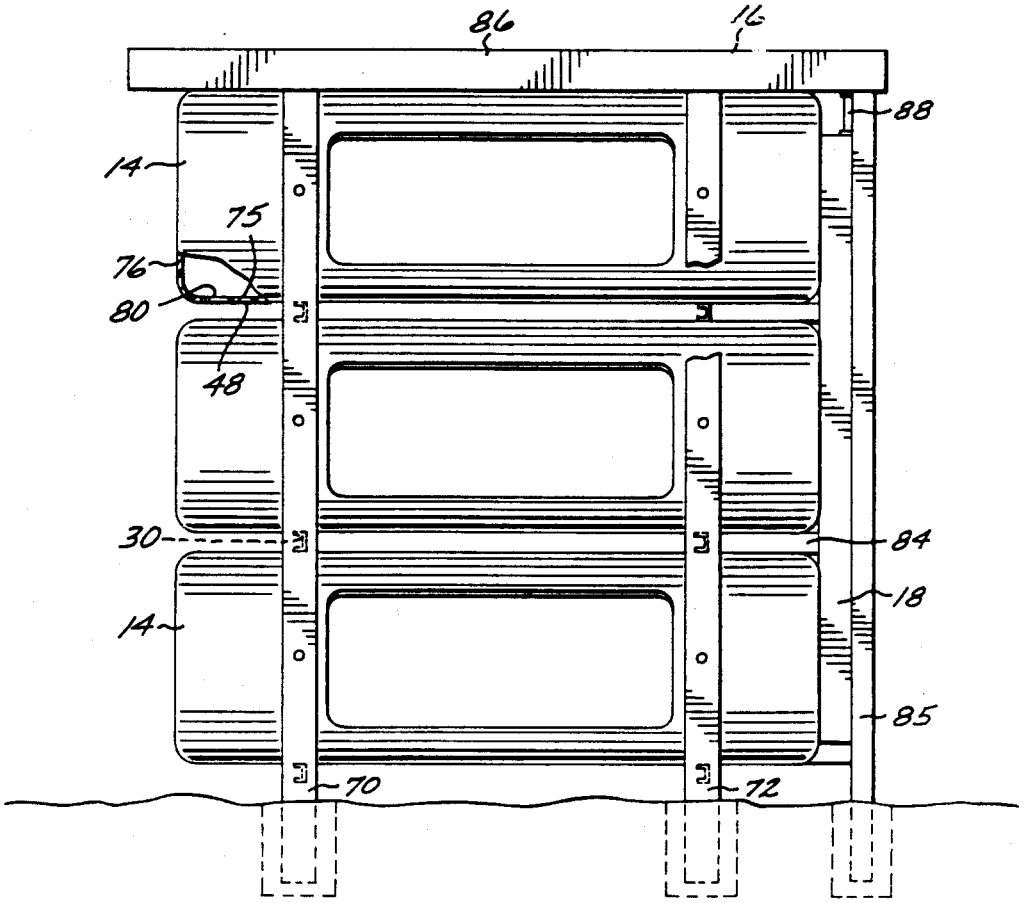
FIG. 6 is a fragmentary side elevational view of the present invention.

Referring now to FIG. 6, the structural support 12 includes a first and second pair 70 and 72 of vertical support members spaced longitudinally apart from one another. In the preferred embodiment, the vertical support members 24 are spaced apart from each other a distance, for example about four and one-half feed, to provide a stable support for the compartment members 14. The horizontal cross-braces 30 are correspondingly vertically positioned to extend laterally between the vertical support members 24 to and define the generally horizontal planes upon which the compartment members 14 are positioned.

In addition, as best shown in FIG. 6, the bottom portion 48 of the compartment member 14 is formed with a slight downward slope within its top surface 75 along its longitudinal axis towards a first end 76 of the compartment member 14. A slope of about ⅛ of an inch drop per foot of length is adequate. Formed within the bottom portion 48 of the compartment member 14, adjacent the first end 76, e.g., at the lowest point of the sloping top surface 75 of the bottom portion 48, is a cut-out or drain 80 of about four inches in diameter. In the preferred embodiment the drain 80 is formed in an end substantially opposite from the window 60. While any conventional construction material may be used, the compartment members 14 may advantageously be constructed of double-walled fiberglass. By this construction, each individual compartment member 14 are readily washable and maintainable in a clean and sanitary condition. Furthermore, each individual compartment member 14 is generally more resistant to the effect of weather and less likely to conduct heat to the outside of the container in inclement weather.

Extending longitudinally between the generally vertical support members 24, i.e., between the first and second pairs of vertical support members 70 and 72, are longitudinal support members 84. These longitudinal support members 84 extend from the vertical support members 24 outward at a first end of the support structure 12 to extend adjacent the second end 44 of the compartment member 14, adjacent the window 60.

Mounted to the longitudinal support members 84 is the light box 18 which provides lighting to the hollow interior of the compartment member 14 through the window 60. A standard 4-foot, 6-inch width, by 6-foot, 3-inch height bus stop billboard box can be used and mounted to the ends of the longitudinal support members 84 and thus positioned adjacent or juxtaposed against the windows 60 formed within the second end wall 44 of the compartment members 14. A second plurality of generally vertical support members 85 may extend upward from a base 22 to support the light box 18. Fluorescent or incandescent lighting can be used, not only to provide light but also to generate indirect heat to the interior of the compartments 14. Electrically connected to the light box 18 and mounted atop the vertical support members 24, above the compartment member 14, is the power source 16. While any self-contained power source may be used, nickel-cadium electrical storage batteries (not shown) may provide an electrical power source 16 for the light box 18 and for any additional heating elements (not shown) within the temporary shelter structure 10 themselves. A solar collector 86 is electrically connected through electrical conduit 88 to the light box 18 and may also provide power for electrical outlets (not shown) adjacent each particular compartment member 14. By incorporating the light box 18 into the structure of the shelter 10, commercial advertisements may be solicited to help reduce the cost of building and supplying such temporary shelters, electrical power can be provided to maintain the individual compartments warm and dry, and the public screened from the shelters 10, reducing the unsightliness of the local environment. As an alternative to the solar power described, a local source of commercial power may also be used if it is readily available and practical to use. Such local power could be supplied, for instance, by appropriately secured nonstandard plug terminals located conveniently in locations that are likely to accomodate such structures from time to time. For instance, such terminals may be located in the inner city in cold climates for use in the winter months when the homeless are exposed to inclement weather.

From the above, those skilled in the art will appreciate that the present invention represents a new and useful structure for transients or other displaced persons that embodies many advantages over previously available temporary structures. It will also be apparent that from the foregoing that, while particular forms of the invention have been illustrated and described, various modifications can be made without departing from the spirit and the scope of the invention. Accordingly it is not intended that the invention be limited, except as by the appended claims.

What is claimed is:

1. A shelter structure comprising:

a base;

a plurality of support members including a plurality of vertical support members, said vertical support members extending upwards from said base, and a plurality of longitudinal support members, said longitudinal members mounted to said vertical support members;

a plurality of essentially horizontal cross-braces attached to said support members;

a plurality of compartment members mounted to said cross-braces, said compartment members having at least one essentially cylindrical side wall and a pair of enclosing end walls, said side wall extending between said enclosing end walls and having a top, side and bottom portions, said side wall and said enclosing end walls defining a hollow interior, said side wall including a longitudinal entrance opening formed within said side portion, said longitudinal opening includes an essentially rectangular opening formed longitudinally within said side wall, a top edge and a bottom edge, said top edge projecting laterally outward beyond said bottom edge, said end wall having a window formed therein;

drain means for promoting cleaning and sanitization of said shelter structure, said drain means formed within said bottom portion, and includes said bottom portion having a sloping top surface with a lowest point adjacent one end of said hollow interior, and a drain opening formed at said lowest point of said bottom portion;

isolated light means for illuminating the interior of said compartment members, said light means includes a billboard light box having communicating indicia mounted to said longitudinal support members and positioned outside said hollow interior defined within said compartment member and adjacent said windows for communicating light therethrough and concurrently illuminating said communicating indicia in a second direction therefrom; and independent power means for illuminating said light means, said power means electrically connected with said light means.

2. A shelter structure comprising:

a base;

a plurality of support members including a plurality of vertical support members, said vertical support members extending upwards from said base, and a plurality of longitudinal support members, said longitudinal members mounted to said vertical support members;

a plurality of essentially horizontal cross-braces attached to said support members;

a plurality of compartment members mounted to said cross-braces, said compartment members having at least one essentially cylindrical side wall and a pair of enclosing end walls, said side wall extending between said enclosing end walls and having a top, side and bottom portion, said side wall and said enclosing end walls defining a hollow interior, said side wall including a longitudinal entrance opening formed within said side portion, said longitudinal opening includes an essentially rectangular opening formed longitudinally within said side wall, a top edge and a bottom edge, said top edge projecting laterally outward beyond said bottom edge, said end wall having a window formed therein;

drain means for promoting cleaning and sanitization of said shelter structure, said drain means formed within said bottom portion, and includes said bottom portion having a sloping top surface with a lowest point adjacent one end of said hollow interior, and a drain opening formed at said lowest point of said bottom portion;

isolated light means for illuminating the interior of said compartment members, said light means includes a billboard light box having communicating indicia mounted to said longitudinal support members and positioned outside said hollow interior defined within said compartment member and adjacent said windows for communicating light therethrough and concurrently illuminating said communicating indicia in a second direction therefrom; and independent power means for illuminating said light means, said power means electrically connected with said light means, and wherein said independent power means includes a solar collector having batteries electrically connected to said light box.

3. A shelter structure comprising:

a base;

a plurality of support members including a plurality of vertical support members, said vertical support members extending upwards from said base, and a plurality of longitudinal support members, said longitudinal members mounted to said vertical support members;

a plurality of essentially horizontal cross-braces attached to said support members;

a plurality of compartment members mounted to said cross-braces, said compartment members having at least one essentially cylindrical side wall and a pair of enclosing end walls, said side wall extending between said enclosing end walls and having a top, side and bottom portion, said side wall and said enclosing end walls defining a hollow interior, said side wall including a longitudinal entrance opening formed within said side portion, said longitudinal opening includes an essentially rectangular opening formed longitudinally within said side wall, a top edge and a bottom edge, said top edge projecting laterally outward beyond said bottom edge, said end wall having a window formed therein;

drain means for promoting cleaning and sanitization of said shelter structure, said drain means formed within said bottom portion, includes said bottom portion having a sloping top surface with a lowest point adjacent one end of said hollow interior, and a drain opening formed at said lowest point of said bottom portion;

isolated light means for illuminating the interior of said compartment members, said light means includes a billboard light box having communicating indicia mounted to said longitudinal support members and positioned outside said hollow interior defined within said compartment member and adjacent said windows for communicating light therethrough and concurrently illuminating said communicating indicia in a second direction therefrom; and independent power means for illuminating said light means, said power means electrically connected with said light means, and wherein said independent power means includes a solar collector having batteries electrically connected to said light box and means to conduct and adapt commercially available power to said light box.

4. A prefabricated shelter structure comprising:

a base;

a plurality of generally vertical support members extending upwards from said base;

a plurality of cross-braces extending generally horizontally at least three horizontal levels and attached to said vertical support members;

at least six tubular members, a pair each of said tubular members mounted to each said cross-brace levels, each of said members having a cylindrical side wall extending the length of said member and first and second enclosing end walls, said side wall and said enclosing end walls defining a hollow interior, said side wall including longitudinal entrance opening formed within said side wall, each said entrance openings of said pair of tubular members opening oppositely outward and having a top and bottom edge, said top edge projecting laterally outward beyond said bottom edge and a bottom portion having a first end and a slope towards said first end and a drain formed within said first end, said first end wall having an opening formed therein;

a synthetic resin window mounted within said end wall opening;

a plurality of longitudinal support members mounted to said vertical support members;

an isolated light box for illuminating the interior of said tubular members, said light means mounted to said longitudinal support members and positioned outside said hollow interior and adjacent said windows for communicating said light therethrough and concurrently illuminating communicating indicia in a second direction therefrom; and solar collector means for powering said light box without requiring additional external power sources, said solar collector means mounted atop said vertical support members, in electrical connection with said isolated light means.

* * * * *